US010526187B2

(12) United States Patent
Knoll et al.

(10) Patent No.: US 10,526,187 B2
(45) Date of Patent: Jan. 7, 2020

(54) WATER DISPENSING APPARATUS COMPRISING A MODULAR AND REMOVABLE HOT WATER EXPANSION TANK, SYSTEMS AND METHODS OF USING

(71) Applicant: Natural Choice Corporation, Loves Park, IL (US)

(72) Inventors: George Knoll, Belvidere, IL (US); Kerry Roosmalen, Rockford, IL (US)

(73) Assignee: Natural Choice Corporation, Loves Park, IL (US)

( * ) Notice: Subject to any disclaimer, the term of this patent is extended or adjusted under 35 U.S.C. 154(b) by 0 days.

(21) Appl. No.: 15/827,706

(22) Filed: Nov. 30, 2017

(65) Prior Publication Data

US 2019/0161336 A1 May 30, 2019

(51) Int. Cl.

| | |
|---|---|
| ***B67D 1/08*** | (2006.01) |
| ***B67D 1/00*** | (2006.01) |
| ***F24H 1/18*** | (2006.01) |
| *B67D 1/12* | (2006.01) |

(52) U.S. Cl.

CPC ..... *B67D 1/0895* (2013.01); *B67D 1/0009* (2013.01); *B67D 1/0014* (2013.01); *B67D 1/0888* (2013.01); *F24H 1/188* (2013.01); *B67D 1/0057* (2013.01); *B67D 1/0864* (2013.01); *B67D 2001/0087* (2013.01); *B67D 2001/0095* (2013.01); *B67D 2001/1259* (2013.01); *B67D 2210/0001* (2013.01); *B67D 2210/0006* (2013.01); *B67D 2210/00034* (2013.01)

(58) Field of Classification Search

CPC ..... B67D 1/0895; B67D 1/0009; F24H 1/18; F24H 1/188

See application file for complete search history.

(56) References Cited

U.S. PATENT DOCUMENTS

| | | | | |
|---|---|---|---|---|
| 3,891,124 | A * | 6/1975 | Dreibelbis | F24D 17/00 222/108 |
| 4,424,767 | A * | 1/1984 | Wicke | F16B 7/0413 122/13.3 |
| 4,513,887 | A * | 4/1985 | Wicke | F16B 7/0413 222/146.5 |
| 5,510,060 | A | 4/1996 | Knoll | |
| 5,518,022 | A * | 5/1996 | Ziehm | F24D 17/00 122/13.3 |
| 6,977,039 | B2 | 12/2005 | Knoll et al. | |
| 7,264,718 | B2 | 9/2007 | Knoll et al. | |
| 7,315,581 | B2 | 1/2008 | Robards et al. | |
| D570,636 | S | 6/2008 | Kulujian et al. | |
| D571,141 | S | 6/2008 | Roosmalen et al. | |
| 7,861,550 | B2 | 1/2011 | Knoll et al. | |

(Continued)

*Primary Examiner* — Nicholas J. Weiss

(74) *Attorney, Agent, or Firm* — Scherrer Patent & Trademark Law, P.C.; Stephen T. Scherrer; Monique A. Morneault

(57) ABSTRACT

Water dispensing apparatus comprises modular components including but not limited to an easily accessible water heating module and a water cooling module. The water dispensing apparatus further comprises a bracket for holding at least one of a valve and an expansion tank onto a hot water tank for easy removal of the same in case of repair or replacement. Moreover, the expansion tank comprises a check valve that opens to allow heated water to flow thereinto and closes after heated water has drained therefrom.

20 Claims, 10 Drawing Sheets

(56) References Cited

U.S. PATENT DOCUMENTS

| | | | | |
|---|---|---|---|---|
| 8,250,972 | B2 | 8/2012 | Santoiemmo | |
| 8,341,975 | B2 | 1/2013 | Knoll et al. | |
| 8,348,243 | B2 | 1/2013 | Schori et al. | |
| 8,651,330 | B2 * | 2/2014 | Krause | B67D 3/0022 222/129 |
| 8,651,331 | B2 * | 2/2014 | Krause | B67D 1/0858 222/129 |
| 8,833,241 | B2 | 9/2014 | Santoiemmo | |
| 8,881,949 | B2 | 11/2014 | Schroeder et al. | |
| 9,161,654 | B2 | 10/2015 | Belmont | |
| 9,409,759 | B2 | 8/2016 | Wilder et al. | |
| 9,427,712 | B2 | 8/2016 | Ring et al. | |
| 9,527,047 | B2 | 12/2016 | Ring et al. | |
| 2005/0218059 | A1 | 10/2005 | Knoll et al. | |
| 2011/0068128 | A1 | 3/2011 | Knoll et al. | |
| 2011/0079612 | A1 | 4/2011 | Knoll et al. | |

* cited by examiner

WATER DISPENSING APPARATUS COMPRISING A MODULAR AND REMOVABLE HOT WATER EXPANSION TANK, SYSTEMS AND METHODS OF USING

TECHNICAL FIELD

The present invention relates to water dispensing apparatus, systems and methods of using the same. Specifically, the water dispensing apparatus comprises modular components including but not limited to an easily accessible water-heating module and a water carbonation module. The water dispensing apparatus further comprises a bracket for holding at least one of a valve and an expansion tank to a hot water tank for easy removal of the same in case of repair or replacement. Moreover, the expansion tank comprises a check valve that opens to allow heated water to flow thereinto and closes after heated water has drained therefrom.

BACKGROUND

Units are known to provide sparkling water, and for heating and cooling water and dispensing the same for users thereof. It is often desirable for a user to select whether he or she wishes to receive water having different properties, such as heated, cooled or carbonated. Typical machines for accomplishing such tasks generally include a tank for holding water and/or a tap water supply line for inputting water therein for dispensing. Oftentimes, machines utilize a tank for chilling the water and a tank for heating the water in the same machine. Moreover, machines that are known to provide carbonation to water to create sparkling water further comprise a carbonation unit comprising a holding tank for dissolving carbon dioxide in water for immediate dispensing when desired.

Typical water dispensing apparatuses often are difficult to maintain as the various components are not easily accessible. Specifically, over time, components of water dispensing apparatuses are known to contain mechanical parts that require periodic maintenance, and may further require replacement. It is often difficult to access the various components to maintain and/or make replacements. For example, dissolved minerals often build-up within components where the water passes and may frequently require replacement. Additionally, many mechanical components required periodic cleaning for optimal use. Oftentimes, it is difficult to access and remove components for periodic cleaning. A need, therefore, exists for a water dispensing apparatus having separate and accessible heating, and carbonating units. More specifically, a need exists for a water dispensing apparatus whereby the individual units, such as the separate heating, and carbonating may be easily accessible and modular so that each can be removed and replaced when necessary.

Oftentimes, water dispensing apparatuses that dispense carbonated water result in finished fluid streams in which carbon dioxide can easily separate from the water. This may result in the dispensed water tasting flat or acidic. It is commonly understood that to control the quality of the carbonated water and ensure the proper mixing of carbon dioxide and water, the water pressure and carbon dioxide pressure may be controlled, and back pressure should be applied to the fluid stream just prior to being dispensed. For many devices, a small threaded pin within the dispensing valve may be adjusted; but this is not easily accessed nor well understood by end-users. A need, therefore, exists for a water dispensing apparatus that effectively ensures proper mixing of carbon dioxide and water. Moreover, a need exists for a simple and easily accessible mechanism to allow an end user to adjust back pressure and flow rate of carbonated water dispensed.

Water dispensing apparatuses that dispense carbonated water require a connection to a pressurized carbon dioxide tank. Oftentimes, tubing from a pressurized carbon dioxide tank is connected to an inlet in the water dispensing machine, but oftentimes the carbon dioxide tank is large and difficult to manage. Some water dispensing machines utilize a relatively small pressurized carbon dioxide tank, such as a 60 L tank, that is typically connected to the apparatus. These relatively small pressurized carbon dioxide tanks require frequent replacement and are often connected via tubing to the rear of the water dispensing system or connected directly to the rear of the water dispensing system, or even under a sink. However, users are easily frustrated by these requirements for changing these smaller carbon dioxide tanks, which are also pressurized and carry warning labels.

Further, threading of the smaller carbon dioxide tanks into a regulator, which adjusts pressure to the correct amount for the water dispensing system, can be an additional frustration for users trying to replace carbon dioxide tanks on a regular basis. Moreover, when connecting to a connection point, such as a regulator, for example, on the water dispensing apparatus, it is often difficult to align the head of the carbon dioxide tank to the connector. A need, therefore, exists for water dispensing apparatuses that provide easy access for relatively small-sized carbon dioxide tanks to connect to and disconnect from the water dispensing apparatuses. In addition, a need exists for water dispensing apparatuses having easily accessible connection points for connecting the carbon dioxide tanks thereto.

Thermal expansion within hot water tank, such as in typical hot water dispensing systems, often leads to the use of an expansion chamber or overflow tank that is positioned atop a hot water tank. Typically, the expansion chamber is permanently affixed to the hot water tank by welding or other means. As water heats inside the hot water tank, it rises into the expansion chamber instead of through the dispensing faucet through one or more holes that are positioned along the outlet tubing from the hot water tank to the faucet. The holes are typically arranged in size and location to aid in pulling the water out of the expansion chamber and into the dispensing stream to the faucet due to the Venturi effect. In this manner, the expansion chamber fills and empties in an ongoing cycle.

However, water that is captured within the expansion chamber is typically never fully emptied and can become stagnant if the tanks do not easily or readily drain. This stagnant water is typically of low quality for purposes of drinking or cooking. A need, therefore, exists for water dispensing apparatuses comprising hot water expansion chambers that effectively capture hot water that overflows from a hot water tank and provides effective draining therefrom when drawn or when the overflow condition ends. More specifically, a need exists for water dispensing apparatuses that provide full draining from an overflow tank so that hot water within the overflow tank does not become stale or stagnant.

Moreover, expansion chambers are typically vented so that hot water can fill and drain easily without increasing pressure within the expansion chamber and/or creating a vacuum when drained, both conditions would prevent proper functioning of the expansion chamber. However, when hot water is drawn from the expansion chamber through the Venturi holes, air from the vents may be drawn with the hot water stream causing turbulent flow that splashes from the faucet. A need, therefore, exists for an expansion chamber whereby only hot water is withdrawn and not air. More specifically, a need exists for an expansion chamber whereby the hot water stream is continuous and smooth without turbulence caused by unwanted air.

In addition, because of the proximity of the expansion chamber to boiling water, mineral scale buildup continually occurs inside the expansion chamber. When the Venturi holes become clogged, the water system itself must typically be disposed of as service is often very difficult or hazardous due the nature of the hot water and electrical systems. A need, therefore, exists for an expansion chamber that is easily replaced in the event of scale buildup or failure. More specifically, a need exists for a modular and separable expansion chamber, and a bracket for easily removing and replacing the expansion chamber when necessary.

SUMMARY OF THE INVENTION

The present invention relates to water dispensing apparatus, systems and methods of using the same. Specifically, the water dispensing apparatus comprises modular components including but not limited to an easily accessible water heating module and a water carbonation module. The water dispensing apparatus further comprises a bracket for holding at least one of a valve and an expansion tank to a hot water tank for easy removal of the same in case of repair or replacement. Moreover, the expansion tank comprises a check valve that opens to allow heated water to flow thereinto and closes after heated water has drained therefrom.

To this end, in an embodiment of the present invention, a water dispensing apparatus is provided. The water dispensing apparatus comprises: a hot water tank for heating water comprising an outlet for withdrawing heated water from the hot water tank, wherein the outlet comprises a first water path to an expansion tank having a vent, wherein heated water flows into and out of the expansion tank through the first water path, and further wherein the first water path comprises a check valve comprising a first blocking element that opens to allow heated water to flow into the expansion tank and closes over the first water path after the heated water within the expansion tank is drained from the expansion tank through the first water path.

In an embodiment, the first blocking element floats in water.

In an embodiment, the expansion tank comprises a cavity extending from the first water path, wherein the cavity is sized to accept and allow the first blocking element to float when filled with water.

In an embodiment, the first water path comprises an aperture between the outlet and the expansion tank.

In an embodiment, the aperture comprises a seat within the expansion tank wherein the first blocking element is sized and shaped to sit within the seat.

In an embodiment, the first blocking element is spherical.

In an embodiment, the first blocking element is spherical.

In an embodiment, the first blocking element is made from a thermoplastic material.

In an embodiment, the outlet comprises a second water path to the expansion tank and a second floating element that opens to allow heated water to flow into the expansion tank and closes over the second water path after the heated water within the expansion tank is drained from the expansion tank through the second water path.

In an alternate embodiment of the present invention, a water dispensing apparatus is provided. The water dispensing apparatus comprises: a hot water tank for heating water comprising a valve inlet for filling water into the hot water tank and an outlet for withdrawing heated water from the hot water tank, wherein the outlet comprises a first water path to a removable expansion tank; a bracket slidably disposed on the hot water tank, the bracket comprising a planar portion and a first slot disposed within the planar portion, wherein the first slot engages at least one of the valve and the expansion tank, wherein sliding the bracket disengages the first slot from the at least one of the valve and the expansion tank allowing the at least one of the valve and the expansion tank to be removed from the hot water tank.

In an embodiment, the bracket comprises a handle for slidably moving the bracket on the hot water tank from an engaged position to a disengaged position.

In an embodiment, the engaged position of the bracket mates the first slot with a mating element on the at least one of the valve and the expansion tank.

In an embodiment, the bracket comprises a second slot in the planar portion, wherein the first slot engages the valve and the second slot engages the expansion tank.

In an embodiment, sliding the bracket disengages the first slot from the valve and the second slot from the expansion tank.

In an embodiment, the valve comprises first threads and the expansion tank comprises second threads, wherein the hot water tank comprises first mating threads for the first threads of the valve and the hot water tank further comprises second mating threads for the second threads of the expansion tank.

In an alternate embodiment of the present invention, a method of attaching and removing at least one of a valve and an expansion tank on a hot water tank is provided. The method comprises the steps of: providing a water dispensing apparatus comprising a hot water tank comprising a valve inlet for filling water into the hot water tank and an outlet for withdrawing heated water from the hot water tank, wherein the outlet comprises a first water path to a removable expansion tank; providing a bracket slidably disposed on the hot water tank, the bracket comprising a planar portion and a first slot disposed within the planar portion, wherein the first slot engages at least one of the valve and the expansion tank; sliding the bracket to a disengaged position causing the first slot to disengage from the at least one of the valve and the expansion tank; and removing the at least one of the valve and the expansion tank from the hot water tank.

In an embodiment, the method comprises the steps of: placing another of the at least one of the valve and the expansion tank onto the hot water tank; and sliding the bracket to an engaged position.

In an embodiment, the bracket comprises a second slot, wherein the first slot engages the valve and the second slot engages the expansion tank, and further wherein sliding the bracket to the disengaged position causes the first slot to disengage from the valve and the second slot to disengage from the expansion tank.

In an embodiment, the method further comprising the step of: removing both the valve and the expansion tank from the hot water tank when the bracket is slid to the disengaged position.

In an embodiment, the method further comprises the steps of: placing another valve and another expansion tank on the hot water tank; and sliding the bracket to an engaged position, thereby locking the valve and the expansion tank onto the hot water tank.

It is, therefore, an advantage and objective of the present invention to provide a water dispensing apparatus having separate and accessible heating, and carbonating units.

More specifically, it is an advantage and objective of the present invention to provide a water dispensing apparatus whereby the individual units, such as the separate heating and carbonating may be easily accessible and modular so that each can be removed and replaced when necessary.

Further, it is an advantage and objective of the present invention to provide a water dispensing apparatus that ensures proper mixing of carbon dioxide and water.

Specifically, it is an advantage and objective of the present invention to provide a simple and easily accessible mechanism to allow an end user to adjust back pressure and flow rate of carbonated water dispensed.

Still further, it is an advantage and objective of the present invention to provide a water dispensing apparatus that provide easy access for relatively small-sized carbon dioxide tanks to connect to and disconnect from the water dispensing machines.

Moreover, it is an advantage and objective of the present invention to provide a water dispensing apparatus having an easily accessible connection point for connecting the carbon dioxide tank thereto.

Further, it is an advantage and objective of the present invention to provide water dispensing apparatuses comprising hot water expansion chambers that effectively capture hot water that overflows from a hot water tank and provides effective draining therefrom when drawn or when the overflow condition ends.

And, it is an advantage and objective of the present invention to provide water dispensing apparatuses that provide full draining from an overflow tank so that hot water within the overflow tank does not become stale or stagnant.

In addition, it is an advantage and objective of the present invention to provide an expansion chamber in a water dispensing apparatus whereby only hot water is withdrawn and not air.

More specifically, it is an advantage and objective of the present invention to provide an expansion chamber whereby the hot water stream is continuous and smooth without turbulence caused by unwanted air.

Moreover, it is an advantage and objective of the present invention to provide an expansion chamber that is easily replaced in the event of scale buildup or failure.

More specifically, it is an advantage and objective of the present invention to provide a modular and separable expansion chamber, and a bracket for easily removing and replacing the expansion chamber when necessary.

Additional features and advantages of the present invention are described in, and will be apparent from, the detailed description of the presently preferred embodiments and from the drawings.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION OF THE PRESENTLY PREFERRED EMBODIMENTS

The present invention relates to water dispensing apparatus, systems and methods of using the same. Specifically, the water dispensing apparatus comprises modular components including but not limited to an easily accessible water heating module and a water carbonation module. The water dispensing apparatus further comprises a bracket for holding at least one of a valve and an expansion tank to a hot water tank for easy removal of the same in case of repair or replacement. Moreover, the expansion tank comprises a check valve that opens to allow heated water to flow thereinto and closes after heated water has drained therefrom.

Figure 1:
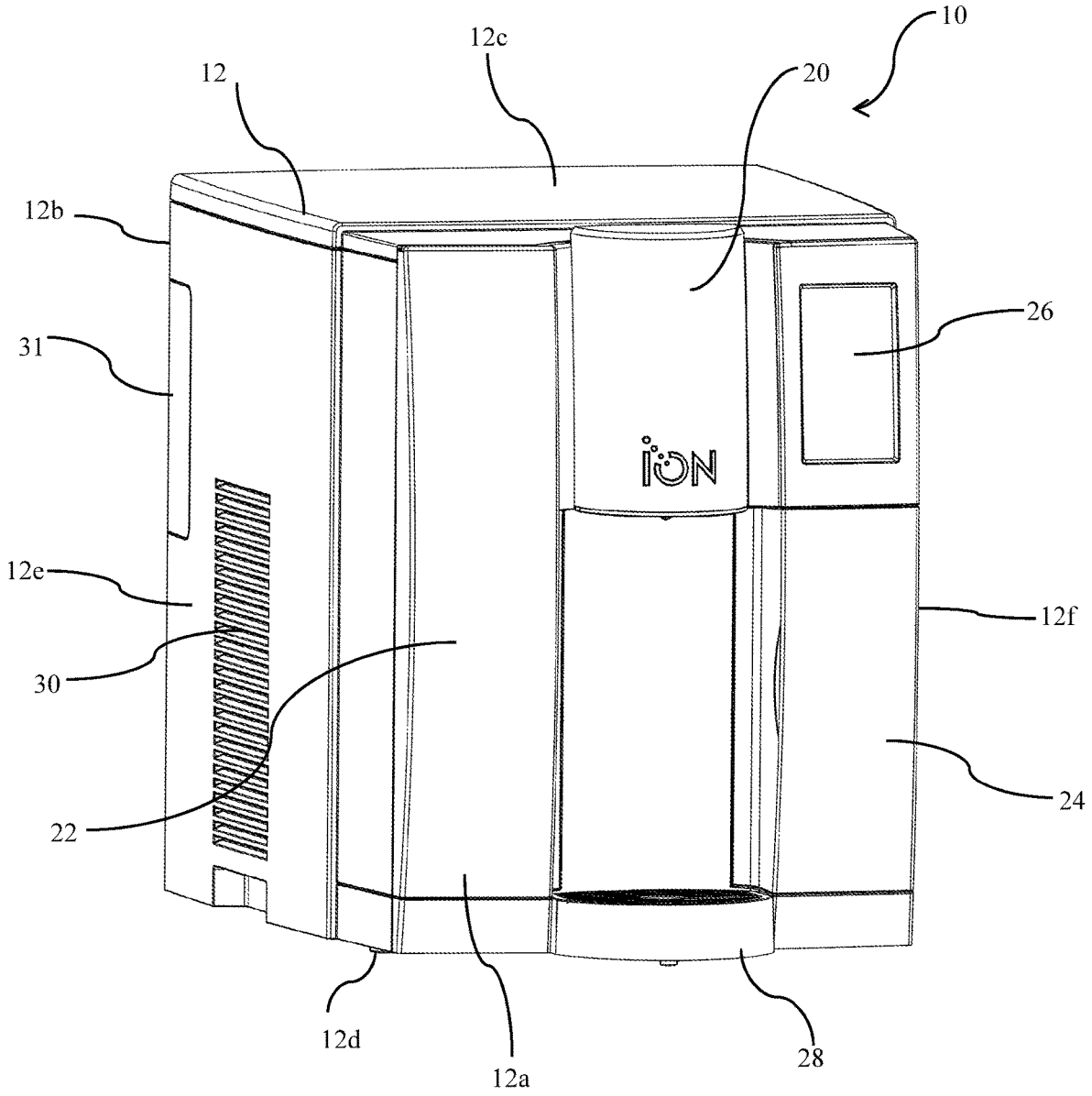
FIG. 1 illustrates a perspective view of a water dispenser apparatus in an embodiment of the present invention.

Now referring in greater details to the drawings, FIG. 1 illustrates a water dispenser 10 in an embodiment of the present invention. The water dispenser 10 includes a housing 12 having a front wall 12*a*, a rear wall 12*b*, a top wall 12*c*, a bottom wall 12*d*, a left side wall 12*e* and a right side wall 12*f* (when facing its front wall 12*a*). The front wall 12*a* further comprises various compartments for holding various elements therein, as described in more detail below, and further has several doors and covers for covering various components, as described in more detail below.

Figure 2:
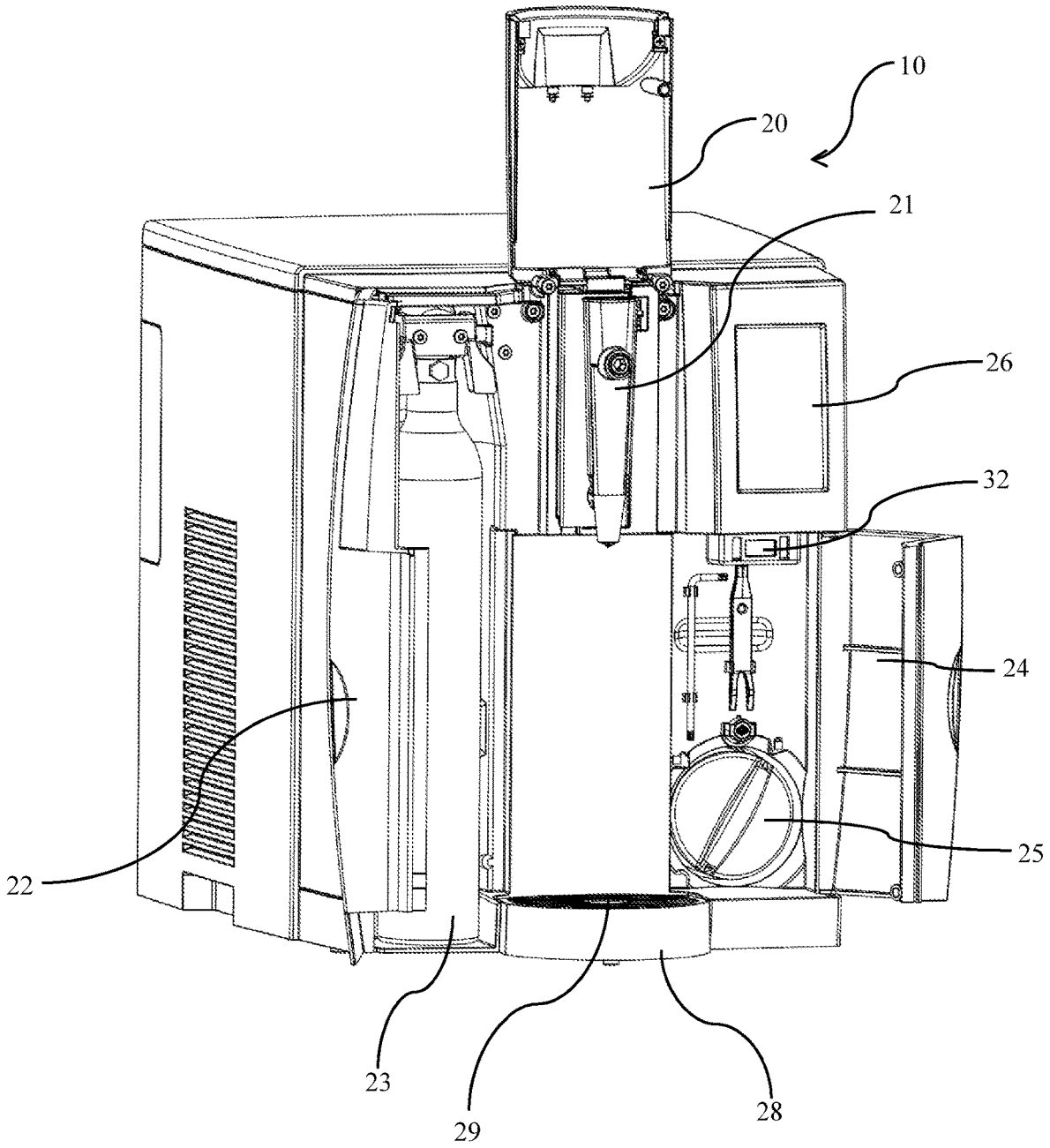
FIG. 2 illustrates a front view of a water dispenser apparatus having doors and covers opened and showing internal compartments thereof in an embodiment of the present invention.

Referring to FIGS. 1 and 2, the front wall 12*a* may comprise a faucet cover 20 that may be hingedly attached to the front wall 12*a* or to the top wall 12*c* of the housing 12 to cover a faucet 21 (as illustrated in FIG. 2), described in more detail below. Further, the front wall 12*a* may comprise a carbon dioxide tank door 22 for covering a carbon dioxide tank 23 and a hinged bracket and valve for holding the carbon dioxide tank therein (as described in more detail below). Moreover, the front wall 12*a* may comprise a filter door 24 for covering a filter 25 and compartment therein for holding the filter 25, as described in more detail below. In addition, the front wall 12*a* comprises a touch-screen control panel 26 for controlling various aspects of the water dispenser 10. A platform-like glass or cup holder 28 may be snap-mounted to the front wall 12*a*, spaced below faucet cover 20 and on which a glass, cup or other beverage container may be positioned below the faucet. In addition, the cup holder 28 may further contain a well 29 for holding water that may spill from the faucet 21. A vent 30 is illustrated in left side wall 12*e*, and it should be noted that various vents may be positioned on the housing 12 in various locations as needed to move air in or out of the housing, as necessary for cooling internal components thereof. A removable door may be provided at a location of a fan bracket assembly (illustrated in more detail in FIGS. 16 and 17, below) for easily accessing the fan bracket assembly without removal of the left side wall 12*e*.

The filter door 24 may further cover a USB slot 32 allowing a flash drive or other USB-enabled element to be inserted therein for upgrading software contained within a processor (not shown) within the water dispenser 10. The processor may control the touch-screen control panel and provide functionality to a user thereof, such as providing the user the ability to select different types of water dispensed therefrom, namely hot still water, cold still water, cold carbonated water, and ambient water, all of which is filtered. Moreover, the processor may control various internal elements of the water dispenser 10, such as a cold water module, a hot water module, a water carbonation module, and various related components thereto, such as a compressor, a heater, a fan, valves, and other like elements, described in more detail below. Moreover, the processor may display error messages and instructions for clearing error messages, or may further provide any other functionality or messaging apparent to one of ordinary skill in the art.

Figure 3:
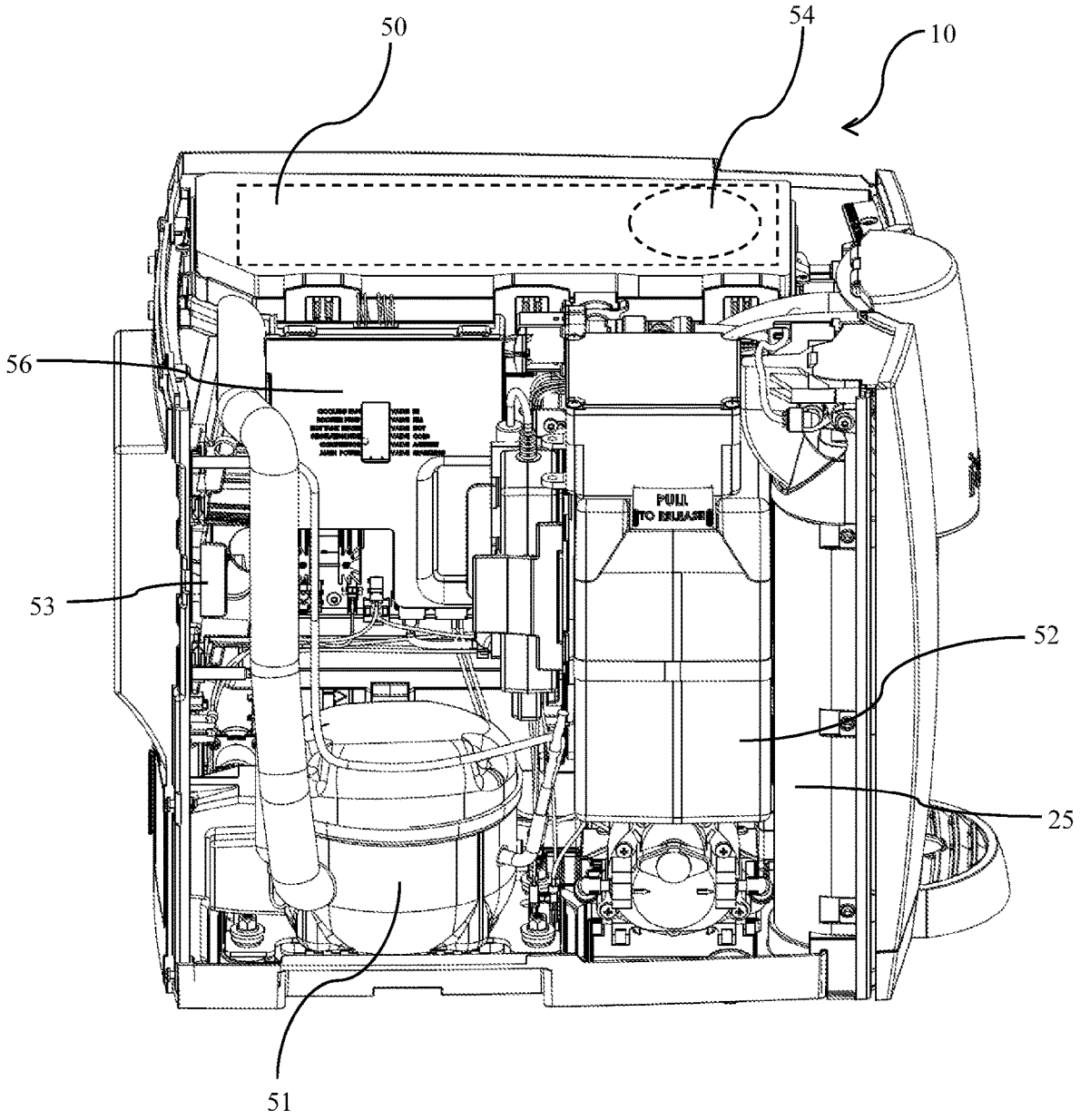
FIG. 3 illustrates a side cut-away view of a water dispenser apparatus in an embodiment of the present invention.

FIG. 3 illustrates various internal components of the water dispenser 10, including a cold water module 50, a hot water module 52, a carbonation module 54, a processor module 56, and a filter module (not shown) having the filter 25 therein. The cold water module 50, the hot water module 52, the carbonation module 54, and the processor module 56 are generally disclosed in co-owned U.S. Pat. Nos. 7,861,550, 8,341,975, and 7,318,581, each of which is incorporated herein by reference in its entirety. Moreover, other components may also be present that may aid in the circulation of the water through the water dispenser 10, including but not limited to, valves, pumps, lines, hoses, insulation for insulating the cold water module 50 and the hot water module 52, and other like components apparent to one of ordinary skill in the art.

Specifically, and as described in one or more of the co-owned U.S. patents, namely, U.S. Pat. Nos. 7,861,550, 8,341,975 and 7,318,581, and as shown in FIGS. 3 and 4, the cold water module 50 may comprise a compressor 51 and evaporator coils (not shown) positioned adjacent to fan module 53 that operate to chill water in an ice bank assembly or ice tank 158 (as illustrated in FIG. 4).

Figure 4:
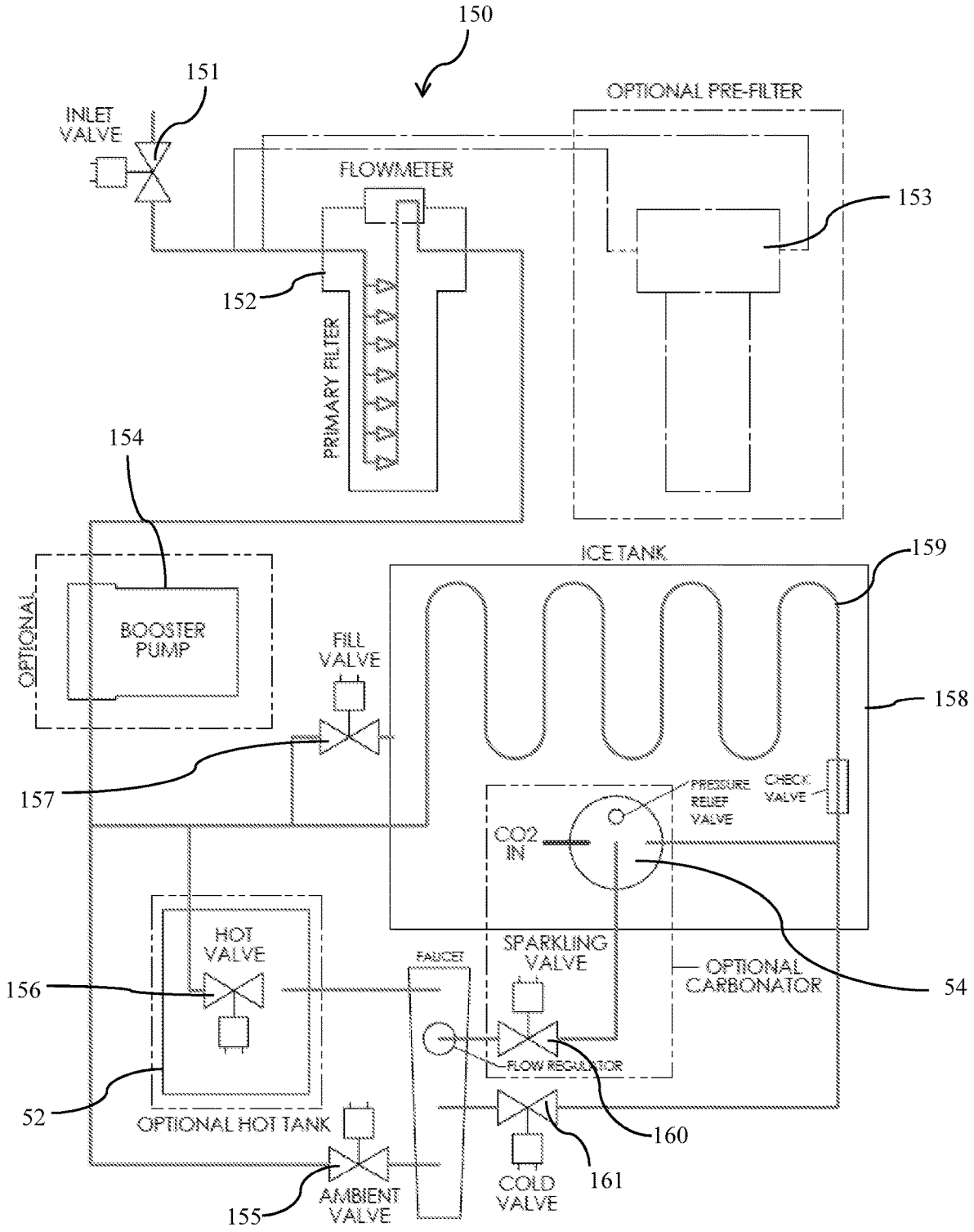
FIG. 4 illustrates a graphical representation of an ice bank assembly and related elements in an embodiment of the present invention.

As illustrated in FIG. 4, a system 150 of the present invention is illustrated showing a diagram of water movement through the present invention. Water may flow into the system of the present invention via an inlet valve 151 and travel to a primary filter 152 and, optionally, an optional pre-filter 153. The filtered water may then flow from primary filter 152 to an optional booster pump 154 that may increase the water pressure for fulfilling the water demand of each component of the system described herein. The water may then flow to an ambient valve 155 for dispensing as ambient water through faucet 21. Alternatively, the water may flow from the primary filter 152 and through optional booster pump 154 to a hot valve 156 into hot tank 52 for heating and dispensing through faucet 21.

Alternatively, water may flow from the primary filter 152 through optional booster pump to a fill valve 157 for filling the ice bank assembly or ice tank 158. Likewise, water may flow into the ice tank 158 through coils 159 to be chilled in the ice tank 158. Chilled water may then flow from the coils 159 into the carbonation module 54 where carbon dioxide may be added. A sparkling water valve 160 may withdraw carbonated water from carbonation module 54 for dispensing through the faucet 21. Alternatively, chilled water may flow from the coils 159 through cold valve 161 to be dispensed as non-carbonated chilled water through the faucet 21.

Figure 5:
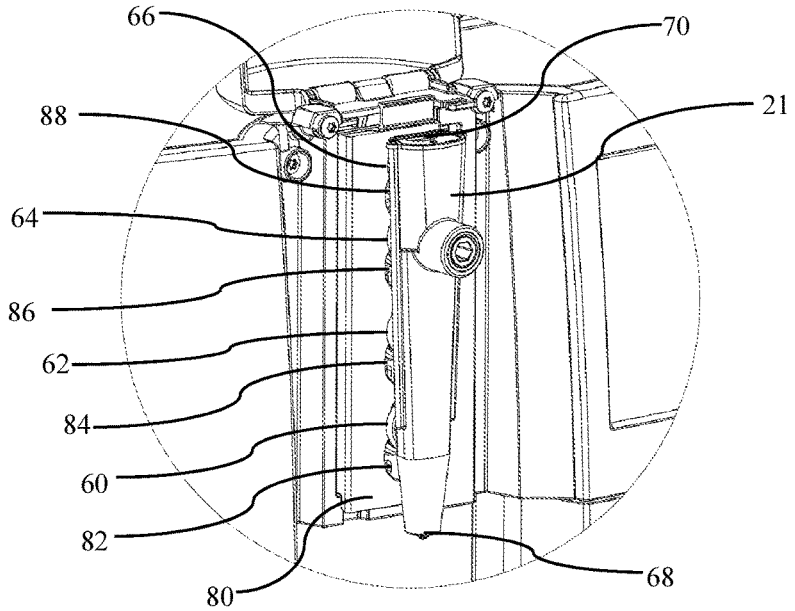
FIG. 5 illustrates a close-up view of a water dispenser faucet on a water dispenser apparatus in an embodiment of the present invention.

FIG. 5 illustrates a close-up perspective view of faucet 21 interconnected with the various water lines and the outlets thereof, namely an ambient water line outlet 60, a cold water line outlet 62, a sparkling water line outlet 64 and a hot water line outlet 66. Specifically, the faucet 21 receives water from any of the aforementioned outlets 60, 62, 64, 66 and funnels the water through faucet mouth 68 on a bottom thereof via gravity. A vent 70 may be disposed on a top of the faucet 21 to ensure that the water flows therefrom without causing a vacuum therein.

Figure 7:
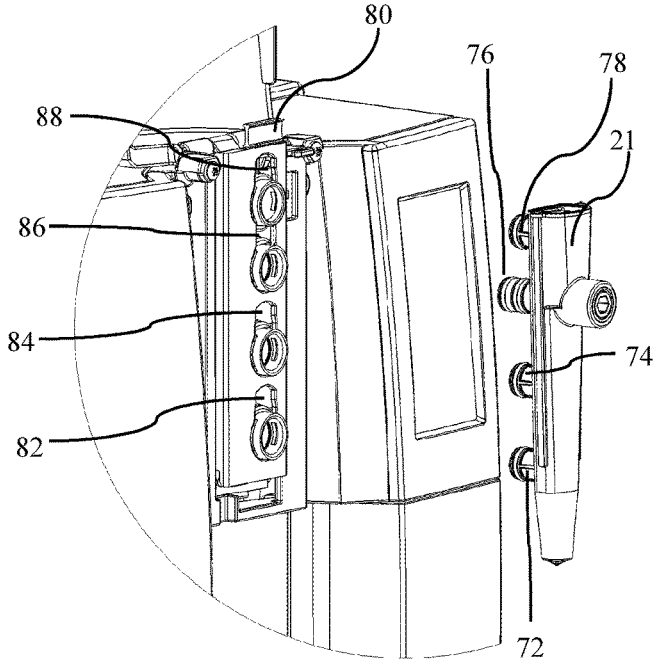
FIG. 7 illustrates an exploded view of a water dispenser faucet and water dispenser apparatus in an embodiment of the present invention.
Figure 8:
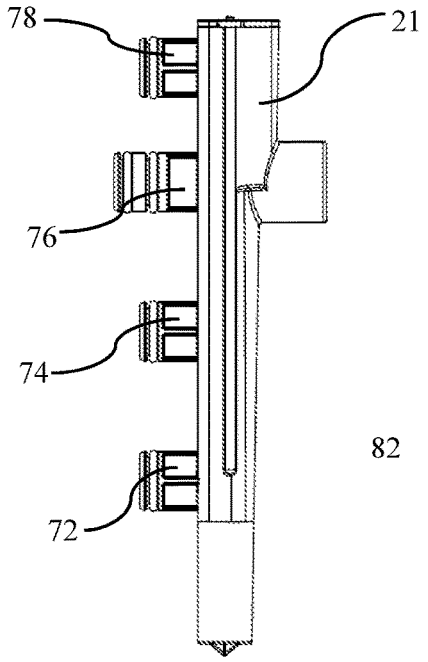
FIG. 8 illustrates a close-up side view of a water dispenser apparatus in an embodiment of the present invention.
Figure 9:
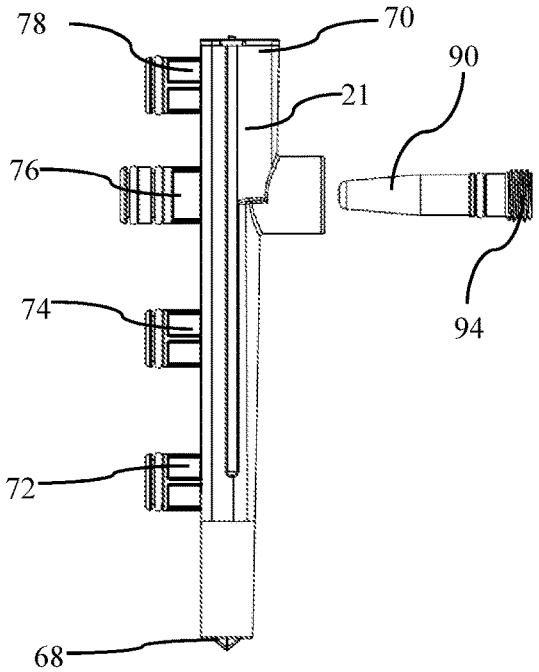
FIG. 9 illustrates a close-up side view of a water dispenser faucet and sparkling water tapered plug in an embodiment of the present invention.
Figure 10:
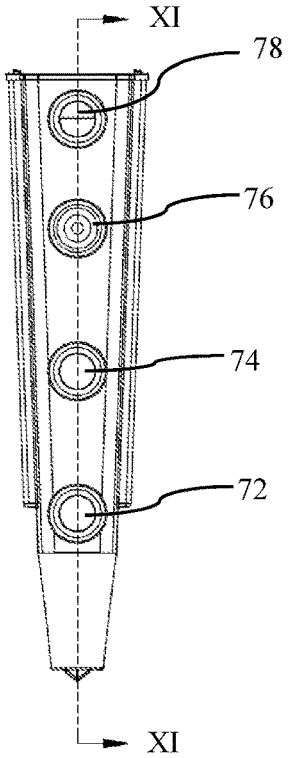
FIG. 10 illustrates a close-up front view of a water dispenser faucet in an embodiment of the present invention.
Figure 11:
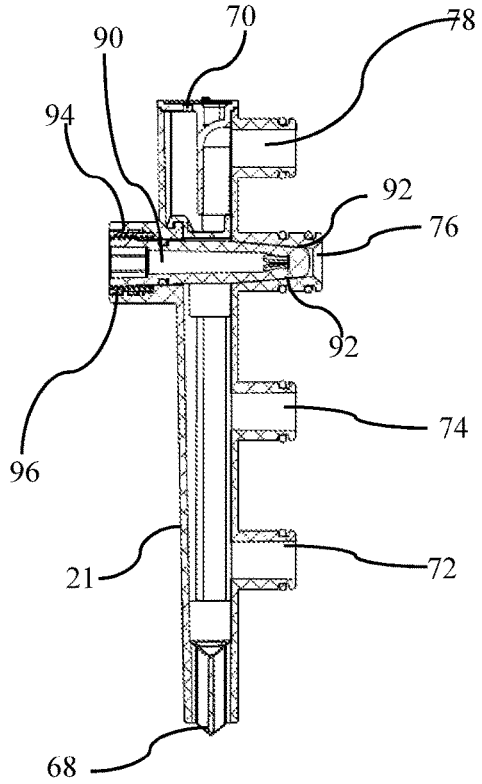
FIG. 11 illustrates a section view along line XI-XI of a water dispenser faucet in an embodiment of the present invention.

The faucet 21 may have a plurality of bosses (as illustrated in FIG. 7), namely an ambient water line boss 72, serving as an ambient water dispenser, that interconnects with the ambient water line outlet 60, a cold water line boss 74, serving as a cold water dispenser, that interconnects with the cold water line outlet 62, a sparkling water line boss 76, serving as a sparkling water dispenser, that interconnects with the sparkling water line outlet 64, and a hot water line boss 78, serving as a hot water dispenser, that interconnects with the hot water line outlet 66, as illustrated in FIG. 7. Each boss may have an O-ring for sealing the same when fitted within each respective line outlet so that water does not leak from the point of interconnection.

Figure 6:
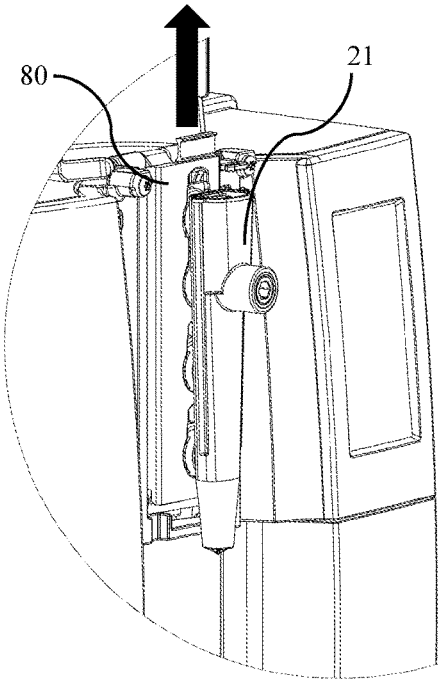
FIG. 6 illustrates a close-up view of a water dispenser faucet bracket in an embodiment of the present invention.

Referring now to FIG. 6, the faucet 21 may be easily removable from the water dispenser 10 by manually pulling up on bracket 80, having a plurality of locking apertures 82, 84, 86, 88, as shown in FIG. 7. Each locking aperture 82, 84, 86, 88 may have a keyhole shape or a round opening beneath a slotted opening, and when pressed down, the upper slotted openings thereof may interconnect with mating grooves on the sides of the bosses 72, 74, 76, 78, respectively. By manually pulling up on the bracket 80, the slotted openings clear the mating grooves on the sides of the bosses 72, 74, 76, 78 and the faucet 21, may thus be removable from the bracket through the round openings of each of the locking apertures 82, 84, 86, 88, respectively, as illustrated in FIGS. 6 and 7.

FIGS. 8-11 illustrate close-up views of the faucet 21 and, specifically, the bosses 72, 74, 76, 78, and a tapered plug 90 that operates as a flow restrictor that may be disposed within the faucet 21 inside the sparkling water line boss 76. The tapered plug 90 may generally fit a mating surface 92 within the sparkling water line boss 76, and further may have thread 94 that mates with thread 96 within a plug opening 98 that forms a passage from one side of the faucet 21 to the other and into the sparkling water line boss 76. The tapered plug 90 may be manually moved into and out of boss 76, thereby increasing or decreasing, respectively, the rate of sparkling water flow therethrough. Thus, the tapered plug may manually move closer or further away from mating surface 92. When the tapered plug moves closer to mating surface 92, the flow of sparkling water therethrough may be restricted due to the relatively smaller passageway provided between the tapered plug 90 and the mating surface 92. Likewise, when the tapered plug moves further away from the mating surface 92, the flow of sparkling water therethrough may be increased due to the relatively larger passageway provided between the tapered plug 90 and the mating surface 92.

It is desirable to control the flow rate of the sparkling water dispensed from the faucet 21 to ensure proper mixing of carbon dioxide and water. A user may adjust the position of the tapered plug within the sparkling water boss 76 to induce back pressure on the sparkling water and prevent separation of carbon dioxide from the water. A driver, such as a hex tool, may be used to turn the tapered plug 90 within the sparkling water boss 76 thereby opening or closing the boss 76 and impacting the rate of the flow of water therethrough and the back pressure induced on the sparkling water stream. The position of the tapered plug may further be adjusted via a grippable knob that may be grasped and rotated, thereby not requiring a tool for turning the same. Moreover, limits may be set on the tapered plug 90 to prevent over-turning, thereby preventing the tapered plug 90 from opening or closing too far.

Figure 12:
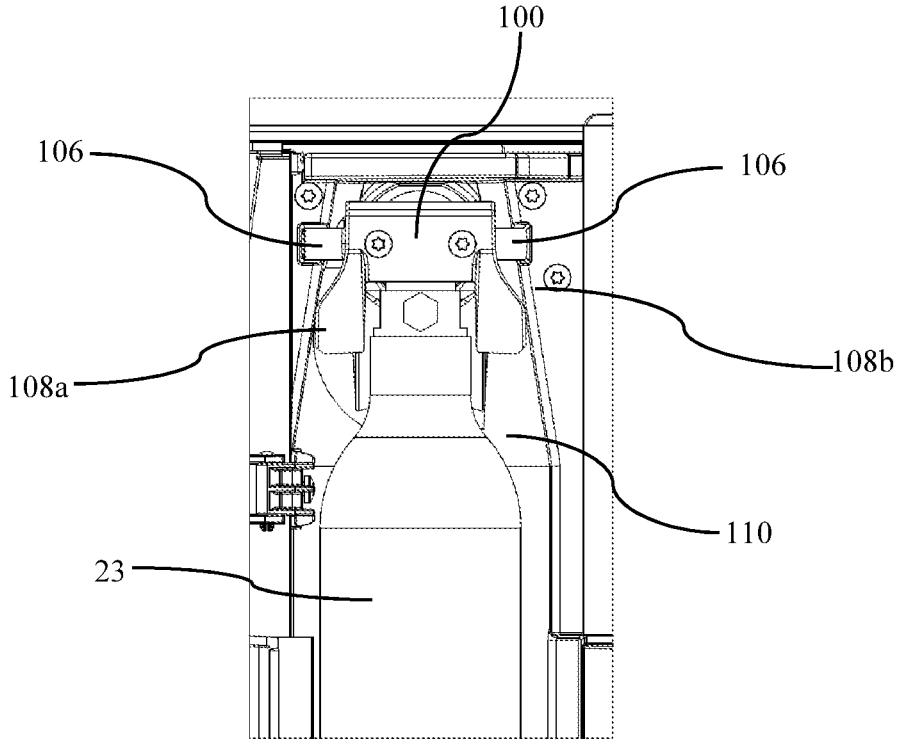
FIG. 12 illustrates a close-up front view of a carbon dioxide tank bracket connector and regulator in an embodiment of the present invention.
Figure 13:
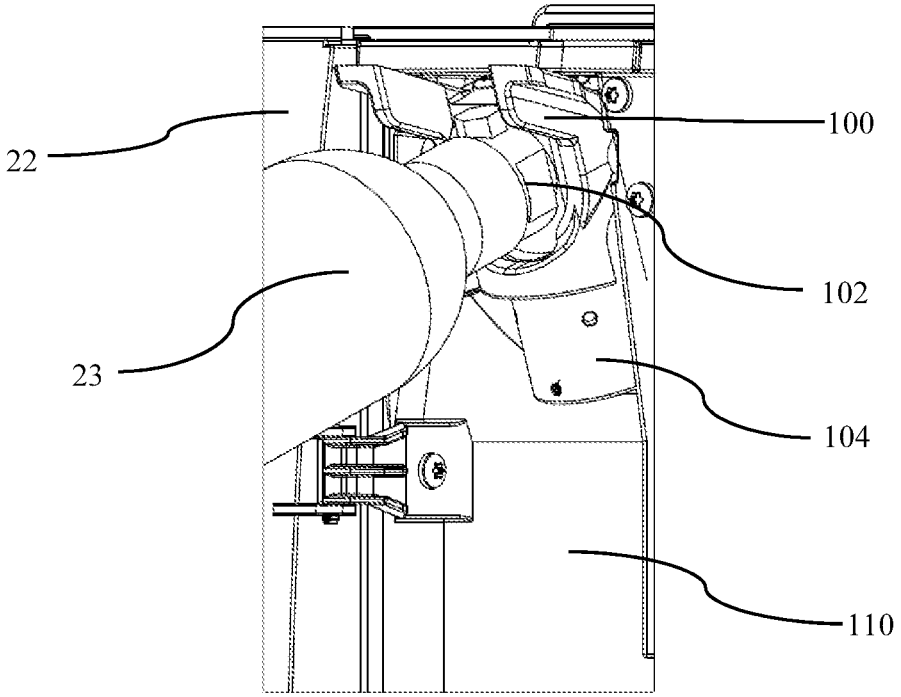
FIG. 13 illustrates a side front view of a carbo dioxide tank bracket connector and regulator connected to a carbon dioxide tank in an embodiment of the present invention.
Figure 14:
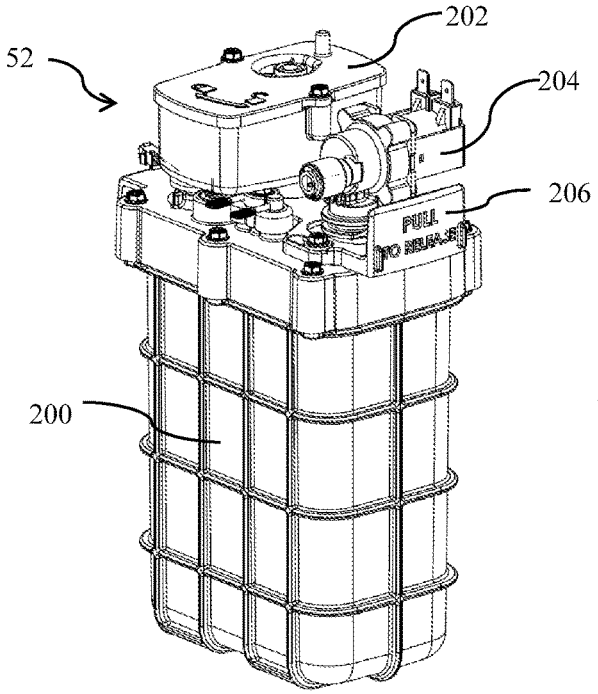
FIG. 14 illustrates a perspective view of a hot water tank in an embodiment of the present invention.

FIG. 12 illustrates a carbon dioxide tank bracket 100 in an embodiment of the present invention. The bracket 100 may have a threaded aperture 102 for receiving a carbon dioxide tank, namely a 60 L carbon dioxide tank with a threaded head thereon. The bracket 100 may further have a manifold/regulator 104 for holding the carbon dioxide tank 23 and distributing carbon dioxide under pressure to the carbonation module 54. The bracket 100 may further have rotating axle 106 that may allow the bracket 100 and the manifold/regulator 104 to rotate, as illustrated in FIG. 13, thereby exposing the threaded aperture 102 allowing the threaded head of the carbon dioxide tank to be received therein. Line A-A illustrates the axis of rotation of the axle 106 and the arrow illustrates the direction of flow of gas through the manifold/regulator 104, which may be transverse, preferably perpendicular, to the axis of rotation along line A-A of axle 106. Thus, pressurized gas from the carbon dioxide tank 23 flows normal to the axis of rotation along line A-A of axle 106 through the manifold/regulator 104 to the carbonation module 54.

Handle wings 108*a*, 108*b* may be provided to allow a user to pull and rotate the bracket 100, exposing the threaded aperture 102, thereby allowing the carbon dioxide tank 23 to be threaded thereto. Once fully threaded therein, the carbon dioxide tank 23 may be rotated via rotation of the bracket 100 to fit within enclosure 110. Door 22 may be closed over the carbon dioxide tank 23 so that the same is not visible when in use. The manifold/regulator 104 may provide a specific, regulated pressure of carbon dioxide to the carbonation module 54, as described in more detail above with respect to FIG. 4.

Now referring to FIGS. 14 and 15A-15E, the hot water tank 52 is illustrated in further detail (without insulating material that is shown in FIG. 3), including a hot water reservoir 200, wherein water may be injected and heated via heated filaments (not shown) or via any other method apparatus to one of ordinary skill in the art. The hot water tank 52 may further comprise an overflow element 202, for allowing heated water to overflow into a catch basin in the event of overfill or overheating, and a valve 204 for regulating the filling of the hot water reservoir 200 with filtered water. For ease of removal of the hot water reservoir 200, the overflow element 202 and/or the valve 204, in the case of necessary repairs and the like, a bracket 206 is provided that holds the overflow element 202 and the valve 204 to the hot water reservoir 200 and further allows a user to quickly and easily remove the same when necessary, such as in the case of mineral build-up or wear, and without removing the hot water reservoir 200 from the insulating material.

Figure 15A:
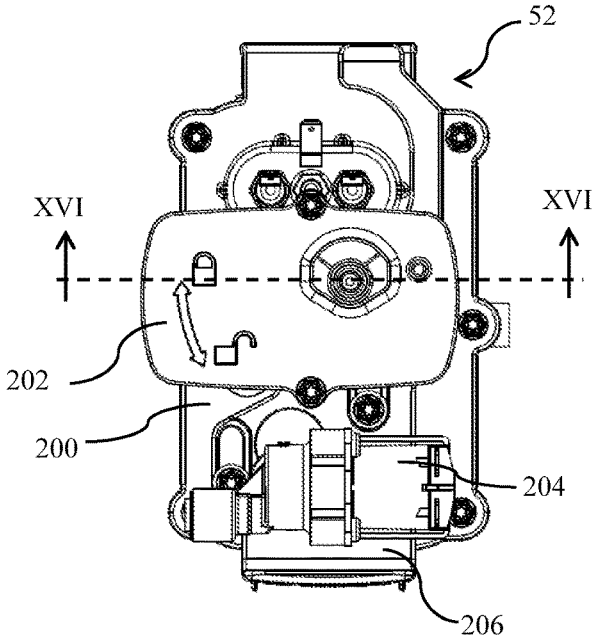
FIGS. 15A-15E illustrate a step-by-step guide for removing an overflow element and a valve from a hot water tank in an embodiment of the present invention.
Figure 15B:
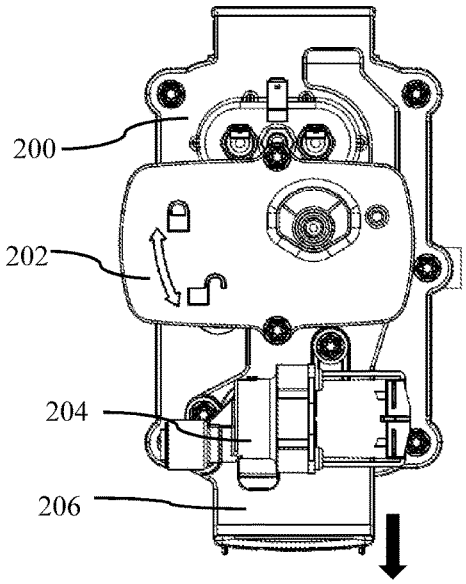
Figure 15C:
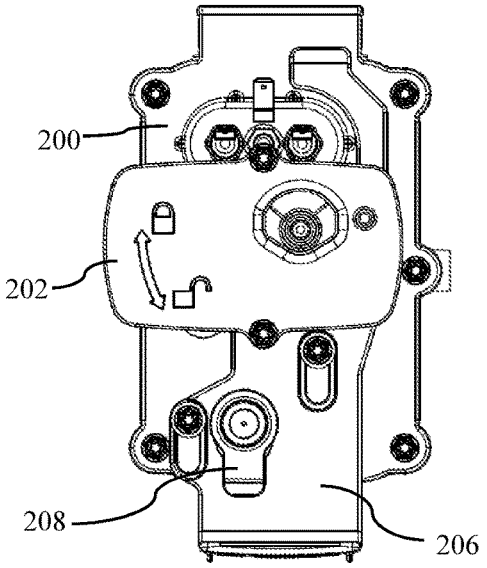
Figure 15D:
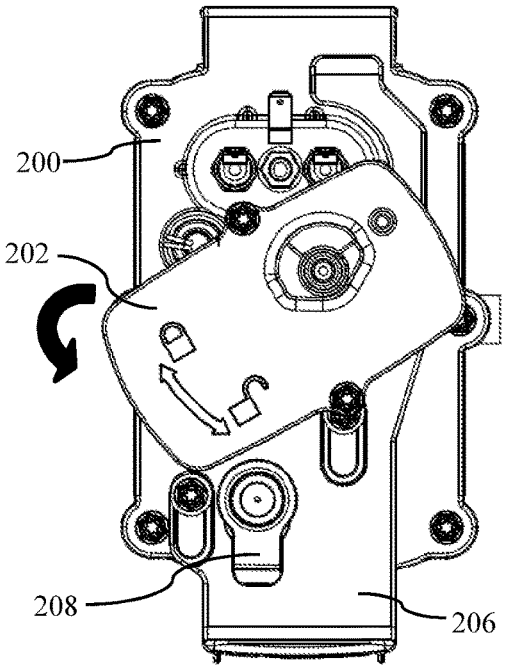
Figure 15E:
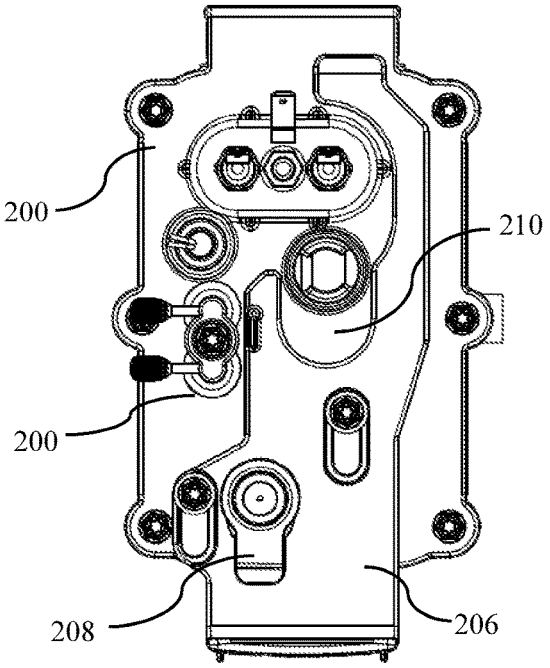

The bracket 206 may comprise a first slotted aperture 208 and a U-shaped holding aperture 210, as illustrated in FIG. 15E, that may hold the valve 204 and the overflow element 202, respectively, when closed, and further allow the release of the same when opened. FIGS. 15A-15E illustrate a step-by-step methodology for opening the bracket 206 and releasing the overflow element 202 and the valve 204. Specifically, FIG. 15A illustrates a top view of the hot water tank 52 comprising the hot water reservoir 200, the overflow element 202, the valve 204 and the bracket 204. By pulling on the bracket 206 downwardly as illustrated in FIG. 15B, the slotted aperture 208 and the U-shaped aperture 210 may release both the valve 204 and the overflow aperture 202 otherwise held thereto within mating grooves therein. The valve 204 may then be removed, as illustrated in FIG. 15C, showing slotted aperture 208.

FIGS. 15D and 15E illustrate the release and removal of the overflow element 202 from the hot water reservoir 200. Specifically, the overflow element 202 may be rotated counter-clockwise, as shown in FIG. 15D, which may release the overflow element 202 from the hot water reservoir 200 by rotating a catch within the connector of the overflow element 202 to the hot water reservoir 200. The overflow element 202 may then be removed, as illustrated in FIG. 15E by pulling upwardly on the same.

Figure 16:
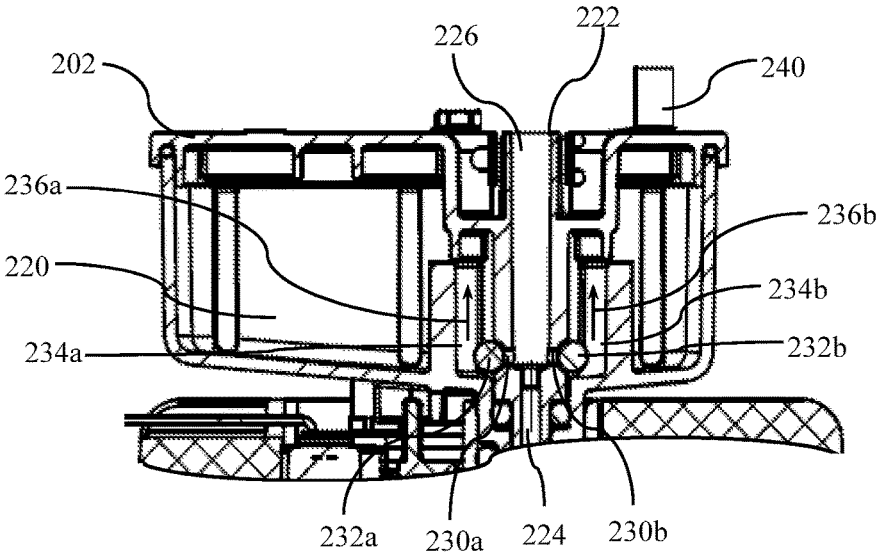
FIG. 16 illustrates a close-up cross-sectional view along line XVI-XVI of an overflow element in an embodiment of the present invention.

FIG. 16 illustrates a cross-sectional view of overflow element 202 along lines XVI-XVI, as illustrated in FIG. 15A. Overflow element 202 provides an expansion tank 220 therein for the overflow of heated water from the hot water reservoir 200 in the case that the hot water reservoir 200 contains a quantity of water that, through heat and expansion thereof, overflows the hot water reservoir 200. Specifically, heated water from the hot water reservoir 200 is normally withdrawn through outlet 222 to a dispense tube (not shown in FIG. 16). Outlet 222 is designed to comprise a narrow outlet section 224 and a relatively wider outlet section 226 that allows heated water to expand from the narrow outlet section 224 to the relatively wider outlet section 226 producing a Venturi effect, enabling the withdrawal of the heated water through the dispense tube to the faucet 21.

However, when the heated water expands but is not dispensed, the expansion tank 220 may hold excess hot water therein until drawn by a user thereof through the faucet 21. Thus, hot water can expand and flow into the expansion tank 220 through openings 230*a*, 230*b*. Check balls 232*a*, 232*b* may normally sit over the openings 230*a*, 230*b*, which may have spherical seats thereon for the check balls 232*a*, 232*b* to sit on, as illustrated in FIG. 16. When water expands and must flow into expansion tank 220, the hot water fills the reservoir, effectively pushing the check balls 232*a*, 232*b* within cavities 234*a*, 234*b*, respectively. Air within expansion tank 220 may exit via vent 240.

The check balls 232*a*, 232*b*, preferably made from a material less dense than water, such as a thermoplastic material, may thereby float within the cavities 234*a*, 234*b*, as illustrated by arrows 236*a*, 236*b* until the heated water is withdrawn back into the outlet 222 via openings 230*a*, 230*b*. As the hot water level drops within the expansion tank 220, the check balls 232*a*, 232*b* may reseat over the openings 230*a*, 230*b*, respectively, blocking air that may fill the expansion tank 220 via vent 240 as the hot water is withdrawn. Thus, while hot water may be withdrawn from expansion tank 220 until empty, air may thus be prevented from entering the outlet 222 due to the air being blocked by the check balls 232*a*, 232*b*, respectively, thereby preventing sputtering when the hot water is dispensed through faucet 21.

Figure 17:
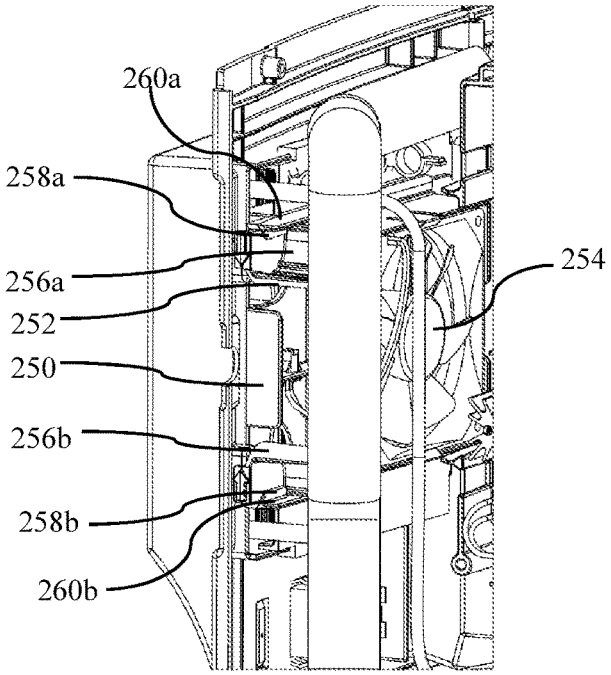
FIG. 17 illustrates a removable fan bracket assembly in an embodiment of the present invention.
Figure 18:
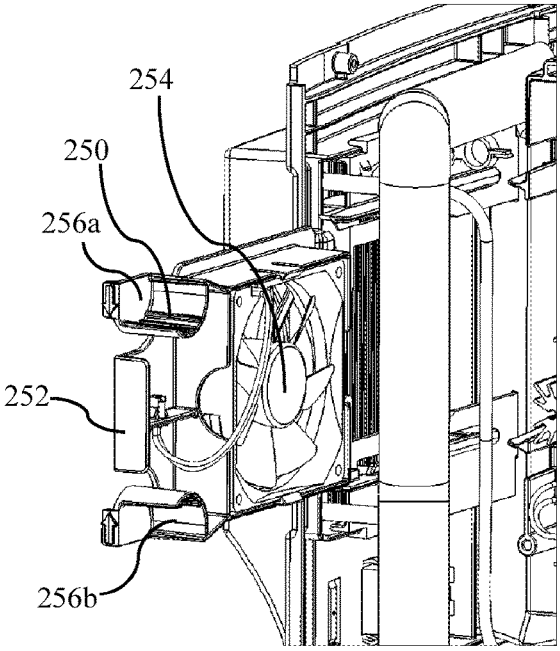
FIG. 18 illustrates a removable fan bracket assembly in a state of removal in an embodiment of the present invention.

In another embodiment of the present invention illustrated in FIGS. 16 and 17, a fan bracket assembly 250 is provided. The fan bracket assembly 250 comprises a fan bracket 252 and a fan 254 disposed therein, and is designed for easy removal of the fan bracket assembly 250 by a user or technician for replacing of the fan 254 when worn or damaged. The fan bracket 252 may comprise grip leaf springs 256*a*, 256*b* that may be squeezed by a user, thereby releasing the grip leaf springs 256*a*, 256*b* from tabs 258*a*, 258*b* that may be disposed on tracks 260*a*, 260*b*. When released, the fan bracket assembly 250 may slide along tracks 260*a*, 260*b* and be removed from the apparatus, as illustrated in FIG. 17. Thus a user may easily remove the fan bracket assembly 250 and, therefore, the fan 254 therein for repair or replacement.

It should be noted that various changes and modifications to the presently preferred embodiments described herein will be apparent to those skilled in the art. Such changes and modifications may be made without departing from the spirit and scope of the present invention and without diminishing its attendant advantages. Further, references throughout the specification to "the invention" are nonlimiting, and it should be noted that claim limitations presented herein are not meant to describe the invention as a whole. Moreover, the invention illustratively disclosed herein suitably may be practiced in the absence of any element which is not specifically disclosed herein.

We claim:

1. A water dispensing apparatus comprising:

a hot water tank for heating water comprising an outlet for withdrawing heated water from the hot water tank, wherein the outlet comprises a first water path to an expansion tank having a vent, wherein heated water flows into and out of the expansion tank through the first water path, and further wherein the first water path comprises a valve comprising a first blocking element that opens to allow heated water to flow into the expansion tank and closes over the first water path after the heated water within the expansion tank is drained from the expansion tank through the first water path, wherein the expansion tank comprises an inlet wherein the inlet of the expansion tank fits within the outlet of the hot water tank and further comprises a connector configured to removably connect the inlet of the expansion tank to the outlet of the hot water tank forming the first water path, allowing the expansion tank to be alternately connected to and removed from the hot water tank.

2. The water dispensing apparatus of claim 1 wherein the first blocking element floats in water.

3. The water dispensing apparatus of claim 1 wherein the expansion tank comprises a cavity extending from the first water path, wherein the cavity is sized to accept and allow the first blocking element to float when filled with water.

4. The water dispensing apparatus of claim 1 wherein the first water path comprises an aperture between the outlet and the expansion tank.

5. The water dispensing apparatus of claim 4 wherein the aperture comprises a seat within the expansion tank wherein the first blocking element is sized and shaped to sit within the seat.

6. The water dispensing apparatus of claim 5 wherein the first blocking element is spherical.

7. The water dispensing apparatus of claim 1 wherein the first blocking element is spherical.

8. The water dispensing apparatus of claim 1 wherein the first blocking element is made from a thermoplastic material.

9. The water dispensing apparatus of claim 1 wherein the outlet comprises a second water path to the expansion tank and a second floating element that opens to allow heated water to flow into the expansion tank and closes over the second water path after the heated water within the expansion tank is drained from the expansion tank through the second water path.

10. The water dispensing apparatus of claim 9 wherein the second blocking element floats in water.

11. The water dispensing apparatus of claim 9 wherein the expansion tank comprises a cavity extending from the second water path, wherein the cavity is sized to accept and allow the second blocking element to float when filled with water.

12. The water dispensing apparatus of claim 9 wherein the second water path comprises an aperture between the outlet and the expansion tank.

13. The water dispensing apparatus of claim 12 wherein the aperture comprises a seat within the expansion tank wherein the second blocking element is sized and shaped to sit within the seat.

14. The water dispensing apparatus of claim 13 wherein the second blocking element is spherical.

15. The water dispensing apparatus of claim 9 wherein the second blocking element is spherical.

16. The water dispensing apparatus of claim 9 wherein the first blocking element is made from a thermoplastic material.

17. A method of moving heated water between a hot water tank and an expansion tank within a water dispensing apparatus, the method comprising the steps of:

providing a water dispensing apparatus comprising a hot water tank for heating water, the hot water tank comprising an outlet for withdrawing heated water from the hot water tank, wherein the outlet comprises a first water path to an expansion tank having a vent, wherein heated water flows into and out of the expansion tank through the first water path, and further wherein the first water path comprises a valve comprising a first blocking element that opens to allow heated water to flow into the expansion tank and closes over the first water path after the heated water within the expansion tank is drained from the expansion tank through the first water path, wherein the expansion tank comprises an inlet, wherein the inlet of the expansion tank fits within the outlet of the hot water tank and further comprises a connector configured to removably connect the inlet of the expansion tank to the outlet of the hot water tank forming the first water path, allowing the expansion tank to be alternately connected to and removed from the hot water tank;

heating water within the hot water tank;

moving heated water from the hot water tank into the expansion tank through the first water path;

withdrawing heated water from the hot water tank to a water dispenser;

moving the heated water within the expansion tank back into the hot water tank through the first water path; and closing the first water path with the first blocking element after the heated water moves back into the hot water tank through the first water path.

18. The method of claim 17 further comprising the step of:

preventing the movement of air into the hot water tank through the first water path with the first blocking element.

19. The method of claim 17 further comprising the step of:

pushing the first blocking element away from the first water path when the heated water moves from the hot water tank into the expansion tank.

20. The method of claim 17 further comprising the step of:

floating the first blocking element within the heated water in the expansion tank after the heated water moves from the hot water tank into the expansion tank.

* * * * *